United States Patent [19]

DesMarais, Jr. et al.

[11] 4,149,853

[45] Apr. 17, 1979

[54] METHOD AND APPARATUS FOR IMPROVING FOSSIL FUEL COMBUSTION AND RELATED EQUIPMENT

[75] Inventors: Raymond C. DesMarais, Jr., North Chelmsford; Ole A. Sandven, Framingham, both of Mass.

[73] Assignee: Rigs Corporation, North Chelmsford, Mass.

[21] Appl. No.: 735,335

[22] Filed: Oct. 26, 1976

[51] Int. Cl.[2] ..... C10L 1/00

[52] U.S. Cl. ..... 44/50; 250/527; 431/4

[58] Field of Search ..... 44/80, 2, 77, 57, 50; 252/386; 431/3, 4

[56] References Cited

U.S. PATENT DOCUMENTS

| | | | |
|---|---|---|---|
| 2,106,661 | 1/1938 | Savage | 44/77 X |
| 2,176,747 | 10/1939 | Schneider et al. | 44/77 X |
| 2,504,361 | 4/1950 | Van Hartesveldt | 252/386 X |
| 3,791,796 | 2/1974 | Gamble et al. | 423/210 X |

OTHER PUBLICATIONS

Ivanov et al., Chem. Abs., p. 131, vol. 80, 1974, 5453m.

Garmasheva et al., Chem. Abs., p. 82, vol. 75, 1971, 119697w.

Brewster et al., Organic Chemistry, 3rd Ed., Prentice-Hall, Inc.: Englewood Cliffs, N.J., 1962, pp. 137–138.

*Primary Examiner*—Charles F. Warren

*Attorney, Agent, or Firm*—Morse, Altman, Oates & Bello

[57] ABSTRACT

The efficiency of fossil fuel combustion equipment, such as engines, furnaces, boilers, and the like, is improved by introducing organic reactive intermediates to the air-fuel mixture prior to ignition. The presence of the reactive intermediates with the fuel improves the combustion reaction by an apparent alteration of the molecular structure of the fuel, resulting in a very high percentage of burning of the fuel. In one embodiment the reactive intermediates are generated from a suitable source compound, such as acetone, which is exposed to a source of ultraviolet radiation thereby converting the acetone into a short-lived, free radical. The short-lived, free radical is then converted into a longer-lived radical by combining it with heavier hydrocarbon molecules. The secondary free radicals are introduced to the air-fuel mixture in advance of the ignition point to improve the combustion reaction.

9 Claims, 11 Drawing Figures

METHOD AND APPARATUS FOR IMPROVING FOSSIL FUEL COMBUSTION AND RELATED EQUIPMENT

BACKGROUND OF THE INVENTION

1. Field of the Invention

This invention relates generally to the combustion of fossil fuel and more particularly is directed towards a new and improved method and associated apparatus for improving fossil fuel combustion and the efficiency of fossil fuel combustion equipment.

2. Description of the Prior Art

In designing internal combustion engines, a primary consideration is to achieve combustion conditions such that a maximum amount of the available potential energy in the fuel is converted to mechanical energy rather than thermal energy. From the aspect of thermodynamic considerations it is evident that, even theoretically, only a fraction of this potential energy can be converted to mechanical energy or useful work. In practice, only a smaller fraction can be converted. The ability or inability of the internal combustion engine to achieve the theoretical conversion efficiency is in part due to the combustion process.

When the air-fuel mixture is ignited in the cylinder of a gasoline engine, a flame front spreads out from the point of ignition and ideally this process should continue uninterruptedly until the air-fuel mixture has been completely burned. However, due to the rapid increase of pressure and temperature, which takes place in the air-fuel mixture as the flame front expands, other reactions can take place in the part of the fuel mixture not yet reached by the flame front. Such so-called delay reactions are believed to consist of temperature-pressure induced decomposition of the fuel molecules followed by a nearly instantaneous reaction with oxygen in the mixture. Such a reaction is in the nature of a detonation and results in shock waves that can impart dangerously high stresses on the engine as well as interrupting the orderly spread of the flame front. This phenomenon commonly known as "knocking", reduces the efficiency of the engine and increases the probability of formation of fixed nitrogen ($NO_x$) as well as unburned hydrocarbons. Even when knocking is not readily apparent such detonations can take place locally in the air-fuel mixture but not to a degree that successively reflected shock waves reinforce each other to the point where the process becomes audible.

To counteract this phenomenon, so-called higher octane fuel is used, the octane rating being the measure of the fuel's ability to undergo compression without audible knocking during subsequent combustion, using as a reference 2,2,4,-trimethylpentane ($C_8H_{18}$) rated at 100 octane.

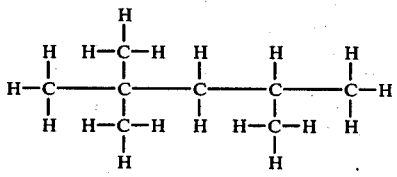

(1)

Anti-knock properties in the fuel are achieved by the use of certain additives, such as tetraethyl-lead, or the use of branched hydrocarbons (alkanes) which, due to the increased compactness of such molecules, are less susceptible to produce pressure-temperature induced detonation. The net effect of the above anti-knock compound is that total air-fuel mixture culminates in a very high percentage burn.

The use of high octane fuel to eliminate knocking presents several drawbacks, including higher cost for such fuel over lower octane fuel and the presence of additives, such as tetraethyl-lead which is not compatible with catalytic convertors now used on most new automobiles to reduce the emission of noxious fumes.

Previous attempts to improve the efficiency of fossil fuel combustion equipment, such as the internal combustion engine, have been only marginally successful. Such measures have included water and steam injection devices, superchargers and the like. None of these, however, has been entirely satisfactory from the standpoint of substantial improvement in combustion efficiency, cost, simplicity, ease of installation and maintenance.

Accordingly, it is an object of the present invention to provide a new and improved method and associated apparatus for improving the efficiency of fossil fuel combustion and the efficiency of fossil fuel combustion equipment, such as internal and external combustion engines, furnaces, boilers and the like. Another object of this invention is to provide a simple, low-cost, efficient method and apparatus for raising the apparent octane rating of gasoline in an internal combustion engine. A still further object of this invention is to provide a novel method and apparatus for generating reactive intermediate compounds for use in fossil fuel combustion equipment.

SUMMARY OF THE INVENTION

This invention features the method of improving the efficiency of fossil fuel combustion and related fossil fuel combustion equipment, comprising the steps of generating organic reactive intermediates and adding the reactive intermediates to the air-fuel mixture prior to ignition. The reactive intermediates are generated by first exposing a source compound of a volatile organic material, such as acetone, to ultraviolet radiation to produce a short-lived free radical. The short-lived free radical is then reacted with heavier hydrocarbons such as in the $C_{16}$ to $C_{20}$ range to produce a long-lived secondary free radical. The secondary free radicals are then injected into the air-fuel mixture prior to ignition.

This invention also features apparatus for generating the reactive intermediate compounds, comprising a container adapted to store a quantity of a suitable source compound, such as acetone, an ultraviolet radiation source communicating with the container for exposing the compound to radiation and thereby produce short-lived free radicals, a reaction stage including a source of heavy hydrocarbons, preferably in the $C_{16}$ to $C_{20}$ range, for converting the short-lived free radicals into long-lived free radicals, and means for delivering the long-lived free radicals to the air-fuel combustion mixture prior to ignition.

DETAILED DESCRIPTION OF THE PREFERRED EMBODIMENTS

Figure 1:
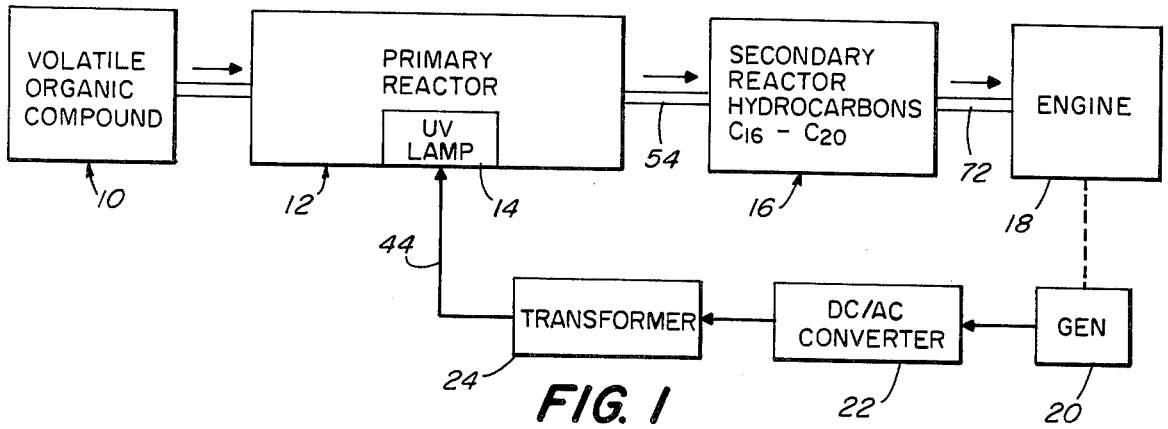
FIG. 1 is a block diagram of a system made according to the invention in use with an internal combustion engine.

In accordance with the present invention, reactive intermediates are injected into the air-fuel mixture in combustion equipment in order to improve the efficiency of the combustion process. The reactive intermediates, according to the invention, are generated locally from a suitable source compound and then injected into the air-fuel mixture prior to ignition. While reactive intermediates may be generated by different techniques, such as heat, pressure, electrolytic processes, etc., imposed on a suitable source compound, the preferred method, according to the present invention, is to subject a suitable source compound to radiation such as ultraviolet light.

While the precise reaction taking place in the practice of the invention is not known with certainty, the following description is believed accurate as presently understood.

In accordance with the present invention, organic reactive intermediates are generated from a source comprised of a volatile, organic compound, such as acetone, by first exposing the compound to ultraviolet radiation and, thereby, producing short-lived free radicals. The action of the ultraviolet radiation upon the acetone in the gas phase breaks down some of the acetone molecules into free radicals.

ACETONE ($CH_3COCH_3$) (2)

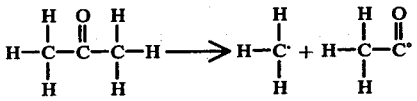

The acetone source compound has the properties of being sufficiently volatile and capable of forming suitable reactive intermediates of a nature beneficial to the combustion process. In practice, the desired reaction is achieved by ultraviolet radiation, with a wavelength whose maximum peak is 24 nm (Nanometers).

The above relatively unstable, short-lived ($10^{-3}$ to $10^{1}$ seconds) free radicals are then reacted with alkanes with carbon chains in the range of $C_{16}$ to $C_{20}$ to convert the short lived, UV-induced, free radicals to relatively stable, longer-lived (10 seconds to ±24 hours) radicals which are formed by the short-lived free radicals combining with the heavier hydrocarbon molecules. The secondary free radicals tend to be more stable according to the stability ranking as follows:

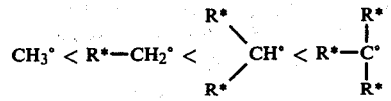

(3)

*alkyl groups, i.e., $C_{16}$–$C_{20}$

These secondary radicals are then combined with the air-fuel mixture as in the intake system of an internal combustion engine, or into the fire box of a furnace, for example. A relatively small and almost trace amount of the reactive intermediates is required to produce satisfactory results when combined with the air-fuel mixture.

While acetone has been found to be a very satisfactory source compound because it is readily available and low in cost, other compounds may also be used to advantage, such as ethene, ethanol, 1,3 butadiene, 1,3,5 hexatriene and others.

The absorption of ultraviolet radiation by organic compounds depends primarily on the presence and arrangements of functional groups. Thus, saturated compounds, such as paraffins and cycloparaffins, are virtually transparent to ultraviolet radiation at the wavelengths above 140 mu, at which level the absorption in the air makes it impractical for the purposes of this invention. The following compounds may be used to advantage as their absorption peaks are large and close to the ultraviolet wavelength employed, as well as being volatile at normal ambient temperatures.

| | | λ Max. | ε* |
|---|---|---|---|
| 1. Acetone | ($CH_3COCH_3$) | ≈280.0nm | 2,900 |
| 2. Ethene | ($CH_2{=}CH_2$) | ≈171.0nm | 15,530 |
| 3. Ethanol | ($CH_3CH$)‖O | ≈160.0nm | 20,000 |
| 4. 1,3 Butadiene | 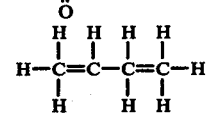 | ≈217.0nm | 20,900 |
| 5. 1,3,5 Hexatriene | 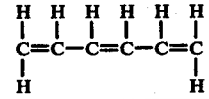 | ≈247.0nm | 56,000 |

*Molar absorbtivity: A/cl where A=optical density, c = molar concentration, l=length of estimated path.

As employed herein, the terms reactive intermediates are defined as free radicals formed by the cleavage of covalent bonds. Such a cleavage can be homolytic in character.

Homolytic cleavage:

$$A{:}B \rightarrow A^{\bullet} + B^{\bullet} \quad (4)$$

occurs when the two electrons in the broken bond are split between the two fragments, thus, generating two neutral entities, each with an unpaired electron available for bond formation, for example:

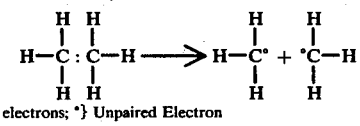

(5)

:} Paired electrons; •} Unpaired Electron

Such entities are called free radicals.

Referring now to FIG. 1 of the drawings, there is illustrated a block diagram of a system made according to the present invention embodied in an internal combustion engine and typically may be installed on a motor vehicle. As shown, this system includes a source 10 of a volatile organic compound, such as set forth above, and typically may be acetone, for example. The vapors from the acetone are fed from the source 10 to a primary reactor 12 where they are exposed to radiation from an ultraviolet lamp 14 whose maximum peak preferably is on the order of 280 mu. The action of the ultraviolet radiation upon the acetone in the gas phase breaks down some of the acetone molecules into primary, short-lived, free radicals as shown in (2) above. The above free radicals are then carried to a secondary reactor 16 where the short-lived free radicals produced in the primary reactor are combined with hydrocarbons typically in the $C_{16}$ to $C_{20}$ range to form secondary, long-lived free radicals. The secondary reactor 16 typically includes alkanes with carbon chains in the $C_{16}$ to $C_{20}$ range to provide the hydrocarbon molecules which produce the more stable, free radicals. The reaction is set forth in (3) above. The secondary radicals produced in the secondary reactor 16 are then delivered to an engine 18, typically to the carburetor portion or its equivalent, to mix with the air-fuel mixture prior to ignition. The engine 18 is provided with a generator 20, the output of which may be used, at least in part, to drive a DC to AC convertor 22 which, in turn, operates a transformer 24 as the power supply for the UV lamp 14.

Figure 2:
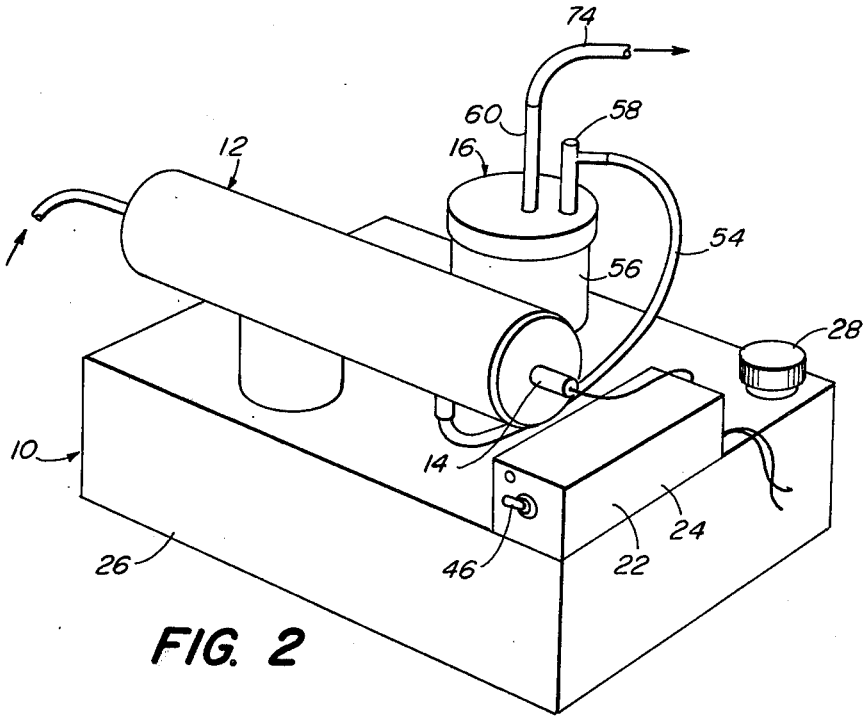
FIG. 2 is a view in perspective of a reactive intermediates generator made according to the invention.
Figure 6:
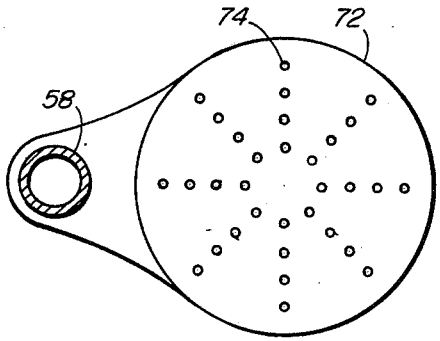
FIG. 6 is a top plan view of the diffuser plate shown in FIG. 5.

In the embodiment of the FIG. 2 system, the various components are organized about a tank 26 adapted to contain a quantity of suitable source compound, such as acetone, corresponding to the supply 10 of FIG. 1. The tank 26, as illustrated, is rectangular in outline and is provided with a filler cap 28 for replenishing the supply of the acetone or other volatile organic compound that may be used. The tank 26 may be formed from a plastic or other suitable material that does not react with the contents. Plastic is preferred wherever possible since the reactive elements will not last in the presence of metal. The top of the tank serves to support the primary reactor 12, the secondary reactor 16, and the power supply comprised of the DC-AC convertor and transformer 22 and 24.

Figure 4:
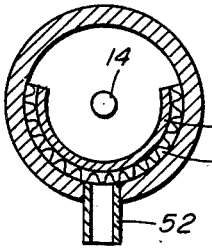
FIG. 4 is a cross-sectional view taken along the line 4—4 of FIG. 3.
Figure 3:
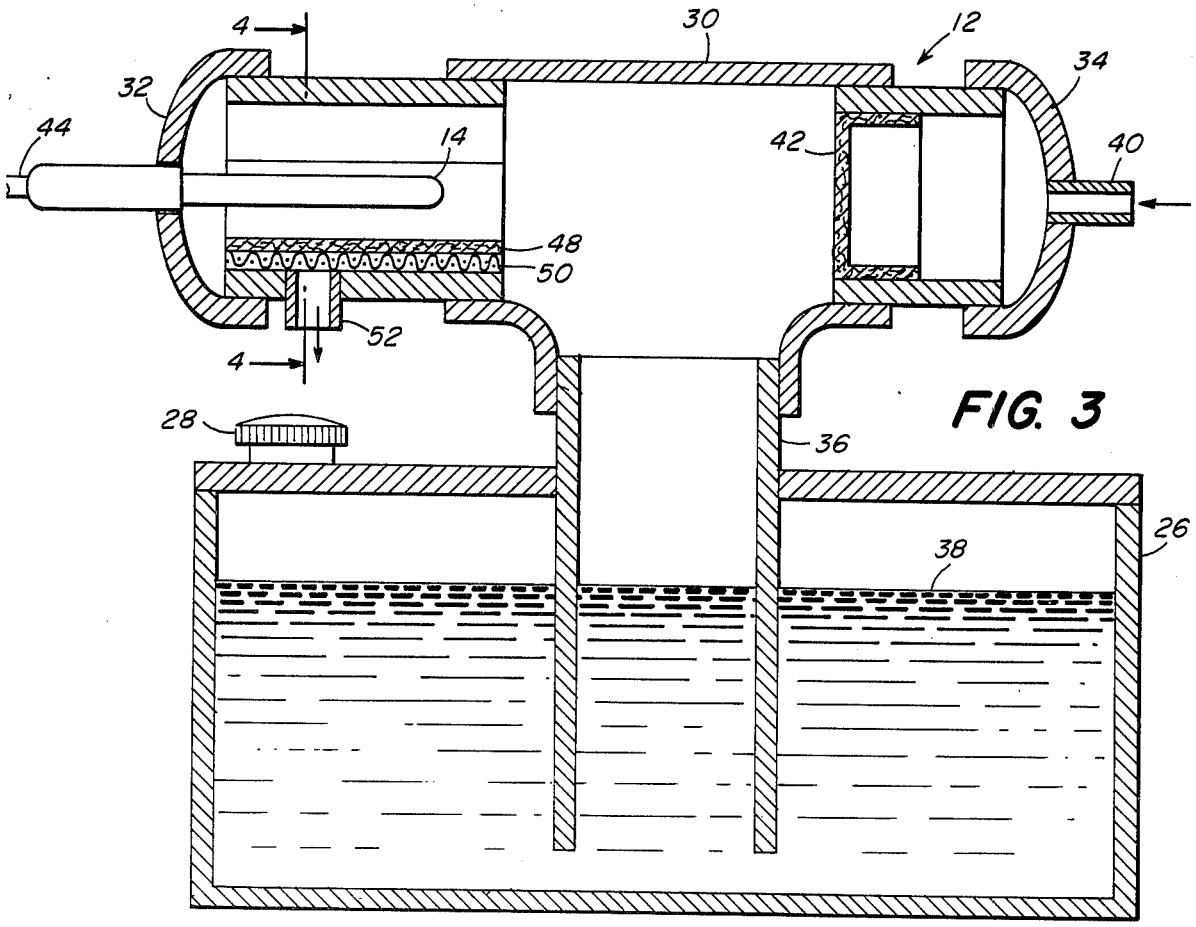
FIG. 3 is a sectional view in side elevation of the first stage of the FIG. 2 generator.

The primary reactor 12 is best shown in FIGS. 3 and 4 and is comprised of a tubular housing 30 mounted horizontally and having end caps 32 and 34. The housing 30 is provided with a central, vertical tube 36 extending through the top wall of the tank down into a quantity of acetone 38 or other suitable organic compound. The tube 36 does not extend to the bottom of the tank but defines a clearance at the bottom through which the acetone partially fills the tube and from which vapors pass up into the primary reactor 12.

In the right-hand end of the housing 30, as viewed in FIG. 3, air is introduced through a conduit 40 which may be connected to a fan, blower, or other means commonly available within a motor vehicle so as to provide a positive air flow into the primary reactor. Directly inside the housing is mounted an air filter 42 for the incoming air.

On the left-hand side of the housing 30, as viewed in FIG. 3, the ultraviolet lamp 14 is mounted and extends coaxially into the housing. The lamp 14 is connected by leads 44 to the power supply which includes the convertor and transformer 22 and 24, as previously indicated. The power supply is provided with a toggle switch 46, although, in practice, the power supply may be energized automatically through a relay circuit connected to the ignition switch of the vehicle.

Mounted directly below the UV lamp 14 in the left-hand end of the housing is a filter 48 on top of mesh screen 50 superimposed upon one another over an outlet port and tube 52. The filter 48 is saturated with a suitable alkane with carbon chains in the range of $C_{16}$ to $C_{20}$ providing heavier hydrocarbon molecules to provide an initial reaction. When the lamp 14 is illuminated and air is flowing through the tube 40, acetone vapors drawn up through the tube 36 will break down from the radiation to produce short-lived free radicals as previously described. These short-lived free radicals are partially stabilized by passing then through the alkane-saturated filter 48.

Figure 5:
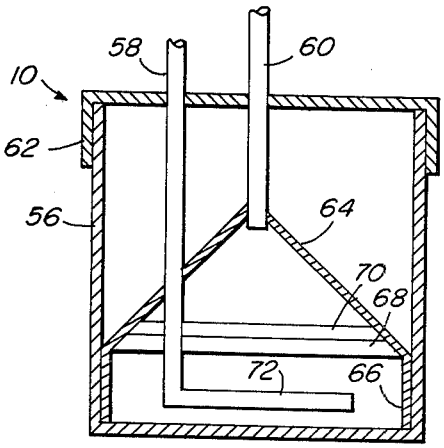
FIG. 5 is a sectional view in side elevation showing the second stage of the FIG. 2 generator.

The discharge from the primary reactor is conducted by means of a tubular conduit 54 to the secondary reactor 16 comprised of a canister 56 and a pair of tubular fittings 58 and 60 extending down through the cover thereof. The secondary reactor, as best shown in FIG. 5, includes the canister 56 having a removable cover 62 through which the fittings 58 and 60 extend. Within the canister is mounted an inverted, funnel-shaped member 64, the lower end of which is raised above the bottom of the canister by means of a sleeve 66. Filters 68 and 70 are mounted within the funnel-shaped member and are saturated with alkanes with carbon chains in the range of $C_{16}$ to $C_{20}$. The tubular fitting 60 communicates with the upper end of the funnel-shaped member 64 and connects to the engine 18 by means of a flexible tubular conduit 74. The fitting 58, which connects to the primary reactor, extends down towards the bottom of the canister, terminating at its lower end in a diffuser 72. The diffuser 72 is in the form of a hollow, circular member communicating with the elongated fitting 58 and formed on its upper face with a plurality of perforations 74 through which the discharge from the primary reactor flows. The gaseous discharge from the primary reactor flows out through the diffuser 72 and passing up through the alkane-saturated filters 68 and 70 completes the conversion of the short-lived free radicals to long-lived free radicals which are then passed through the fitting 60 and the tube 74 to the engine 18, typically in or near the carburetor to combine with the air-fuel mixture prior to ignition.

Figure 7:
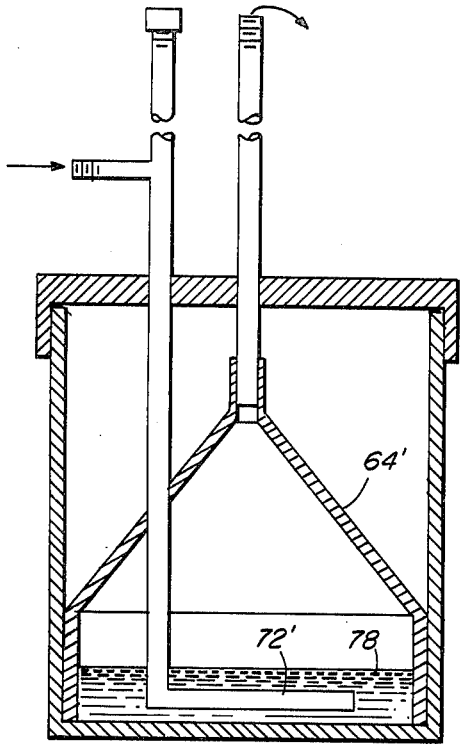
FIG. 7 is a view similar to FIG. 5 showing a modification thereof.

In lieu of the alkane-saturated filters 68 and 70 shown in FIG. 5, these filters may be removed, as shown in FIG. 7, and a quantity of liquid alkane 78 is added to a depth sufficient to cover the diffuser 72' by perhaps ½". In the FIG. 7 embodiment, the gaseous discharge from the primary reactor bubbles up from the diffuser through the liquid 78, completely converting the short-lived free radicals to long-lived free radicals, then funneled up out of the secondary reactor for delivery to the engine.

The ultraviolet lamp 14 employed herein typically draws very little current and operates with about 5 watts power consumption. Normally, the lamp is started with high voltage on the order of 800 volts and, once started, will continue to operate on a voltage of about 600 volts. Preferably the lamp is operated at 60 Hz and is relatively cool in operation. When the lamp is operational in the presence of the acetone vapor, the vapors fluoresce, apparently due to the absorption of the UV by the acetone molecules. The introduction of the reactive intermediates to the fuel-air mixture prior to combustion results in improvements in combustion efficiency. In an internal combustion engine, the presence of the reactive intermediates with the air-fuel mixture produces an apparent increase in the octane rating of the fuel, thereby eliminating knocking of the engine. It is estimated that a 90 octane fuel will combust in a manner similar to a 125 octane fuel when combined with the reactive intermediates. This not only makes the engine operate more smoothly but produces an increase in fuel economy. Further, the reactive intermediates produce a more complete burning of the fuel so that less unburned hydrocarbons appear in the exhaust, thereby, reducing smog and air pollution. Since most fuel is burned there is significantly less carbon deposit on various engine parts, thereby, reducing heat build-up which would otherwise increase the wear on those parts, such as spark plug contacts, piston rings, valves and the exhaust system.

Figure 8:
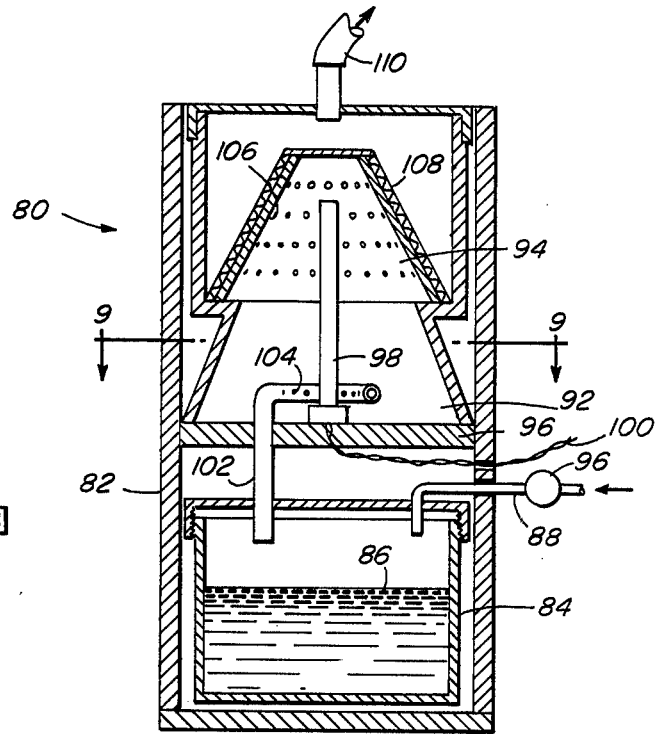
FIG. 8 is a sectional view in side elevation showing a modification of the reactive intermediates generator.
Figure 9:
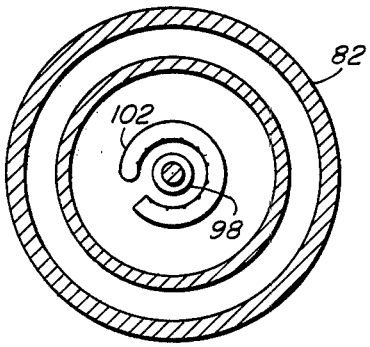
FIG. 9 is a cross-sectional view taken along the line 9—9 of FIG. 8.

Referring now to FIGS. 8 and 9, there is illustrated a modification of the invention and, in this embodiment, a reactive intermediate generator 80 is organized within a cylindrical housing 82, the lower portion of which carries a container 84 for acetone or other source material 86, vented by means of a tube 88 having a valve 90. The upper portion of the housing 82 includes primary and secondary reactor stages 92 and 94. A transverse wall 96 supports a UV lamp 98 powered through leads 100 connected to a suitable power supply. The lamp 98 is straight and extends vertically along the center line of the housing.

A conduit 102 extends between the first reactor stage 92 and the upper portion of the container 84 to provide a passage for the acetone vapors to an area in close proximity to the lamp 98. The upper end of the conduit 102 is C-shaped and extends concentrically about the lamp in spaced relation thereto. A plurality of openings 104 are provided about the inner face of the C-shaped portion through which the vapors are directed towards the lamp. When the vapors discharge into the area near the illuminated lamp, short-lived, free radicals are produced. These short-lived, free radicals move upwardly to the second reactor stage which includes a conical-shaped perforated dome 106 on the outer surface of which is a mesh layer 108 saturated with a suitable heavy hydrocarbon alkane, or the like. The short-lived, free radicals from the first stage pass through the perforated dome 106, through the mesh layer 108 and combine with the oil molecules to become long-lived, free radicals. From thence the free radicals pass through a conduit 110 for delivery to the air-fuel mixture of the engine, fire box, or the like.

Figure 10:
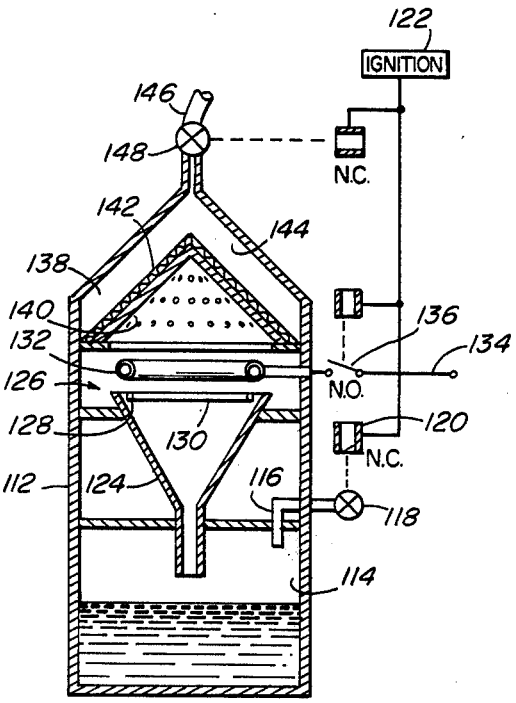
FIG. 10 is a view similar to FIG. 8 showing a further modification thereof.

Referring now to FIG. 10 of the drawings, there is illustrated a further modification of the invention and, in this embodiment, a cylindrical housing 112 is provided with a reservoir 114 on the lower end thereof for storing a suitable source compound, such as acetone, or the like, with the chamber vented by a tube 116 provided with a valve 118. A positive flow of air may be provided through the tube by means of a fan and, as shown, the valve 118 is operated by a relay 120 which, in turn, is energized by the ignition circuit 122 of a motor vehicle in which the system may be installed.

A funnel-shaped guide 124 communicates at its lower end with the chamber 114 and its upper end communicates with a first reactor stage 126 through an annular array of ports 128 formed in a wall 130 across the top of the guide 124. The ports 128 are in close proximity to an arcuate ultraviolet lamp 132 mounted horizontally in the stage 126. The lamp is energized by a lead 134 through a relay switch 136 which is also energized through the ignition circuit 122.

Above the lamp 132 is a second stage reactor 138 comprised of a perforated conical dome 140 supporting a layer 142 of mesh material saturated with heavy hydrocarbons as in the FIG. 8 embodiment. A conical chamber 144, above the second stage, communicates with a discharge conduit 146 through a valve 148 also operated by a relay connected to the ignition circuit 122.

The FIG. 10 system operates in a fashion similar to that of FIG. 8, with the first and second stages in close proximity to one another to provide a more compact unit. In addition, the system is operated in unison with the ignition system of the motor vehicle so as to prevent losses from evaporation as well as insuring that the system will be turned on when the engine is started. If the unit is connected to an oil burner, for example, the relays would be, of course, connected to the thermostat control system so as to go on and off with the heater.

Figure 11:
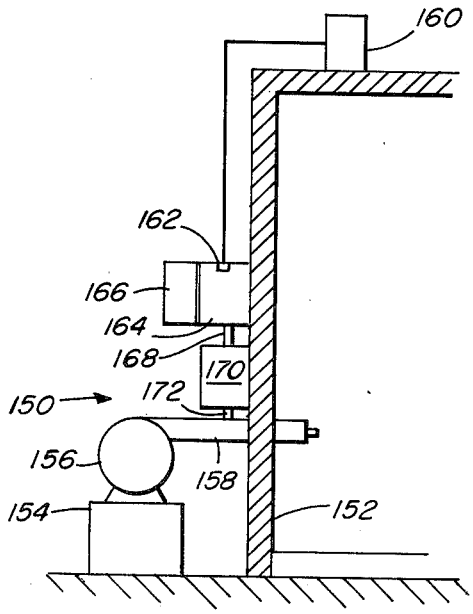
FIG. 11 is a fragmentary, schematic, sectional view showing the system in use with a furnace.

Referring now to FIG. 11 of the drawings, there is illustrated a reactive intermediate generator made according to this invention for use with a furnace 150 which might be a home furnace, industrial boiler, or the like, and typically includes a fire box 152 with the fuel being injected into the fire box by means of a burner 154 comprised of a fuel pump 156 and barrel 158 extending into the fire box. A blower commonly is combined with the fuel gun to provide a flow of air to surround the nozzle of the gun. The system providing the reactive intermediates includes a power supply 160 operating an ultraviolet lamp 162 mounted in a first reactor stage 164. A reservoir 166 is provided proximate to the first stage 164 to supply acetone or other source compounds for producing the short-lived, free radicals. These short-lived, free radicals are then passed through a tube 168 to a second stage reactor 170 providing the alkanes and converting the short-lived, free radicals into long-lived, free radicals. These are then fed into the air-fuel mixture in the gun barrel 158 prior to ignition of the fuel in the fire box.

The reactive intermediates combined with the fuel in the furnace, such as shown in FIG. 11, will result in an increase in the fire box temperature on the order of 250° to 450° F. Stack temperatures will drop by 50° to 150° F. while $NO_x$ will drop up to 33%. CO will drop on the order of 0.15% to 0.04% while the oxygen $O_2$ will drop from 11.4% to 9.20%. $CO_2$ will rise from 6.88% to 8.06%, while the total water vapor content will be down on the order of 29.7% relative to the usable BTU's produced. After a period of use with the system, perhaps 7 to 10 days, most of the visible carbon and soot deposits should disappear from the fire box, flue and stack, while smoke issuing from the stack will be reduced by 85% to 90%.

In a typical installation, less air is required at the inlet and a smaller oil-gun nozzle may be used, thereby, processing less nitrogen through the combustion system. By eliminating most of the carbon soot deposits in any heat exchanger, a far more efficient transfer of heat is achieved because of the insulating effect of carbon and soot. With the introduction of the reactive intermediates, the flame front is made larger per given quantity of air-fuel providing combustion and less nitrogen is processed. Nitrogen is relatively inert to the combustion process and normally provides insulation between the oil droplets formed by the gun nozzle. Therefore, the extra nitrogen present with excess air usually present without reactive intermediates tends to suppress fire box temperature which is conducive to formation of carbon and soot in the heat exchanger from unburned hydrocarbons. Simultaneously, the carbon and the soot deposits absorb heat, preventing heat exchange and, subsequently, the heat rises through the stack, raising the stack temperature which provides conditions for the formation of $NO_x$.

The above condition is somewhat analogous to the generally better efficiency from converting a given heating system from oil to gas ($CH_4$). The natural gas burns much cleaner without carbon and soot and improvements usually are 10% or better as the specific heat of gas is higher as well.

In addition, it follows that with 25% to 30% less air and a smaller oil gun nozzle, which still provides a fire box full of flame, the BTU content of the oil utilized is much greater with reactive intermediates applied. The statistical BTU content of heating oil is 140,000 BTU's per gallon. Summing this phenomenon to the 10% improvement due to no carbon and soot, fuel economies on the order of 25% to 40% may be realized.

A continuing CO to $CO_2$ relationship takes place in the stack, but with higher fire box temperatures and lower stack temperatures the equation tends to favor $CO_2$ formation. Oxygen also drops from 11.40% to 9.20%; however, there is a seeming contradiction with respect to water vapor. It has been observed that more water vapor is issued from the stack per unit of oil consumed after introduction of the reactive intermediates, but since the total amount of water vapor processed with the incoming ambient air is significantly reduced, the overall effect is still much in favor of 25% to 30% less water vapor per BTU provided. Less water vapor is equated with less corrosion as it feeds those resultant oxidation/reduction reactions which follow combustion.

While the invention has been described with particular reference to the illustrated embodiments, numerous modifications thereto will appear to those skilled in the art. For example, a secondary reactor stage may be eliminated by generating relatively long-lived free radicals in the primary reactor. This may be done by using a source compound such as 2, 4 dimethyl 3 pentanone (diisopropyl ketone) instead of those compounds set forth above. Such a source compound has a $\lambda$max. of $\approx$280 nm and an absorbtivity factor of $\sim$2900.

Having thus described the invention, what we claim and desire to obtain by Letters Patent of the United States is:

1. The method of improving the combustion efficiency of fossil fuels, comprising the steps of a. irradiating an organic chemical with ultraviolet light to form free radicals, said chemical being of a class characterized by the formation of short-lived free radicals therefrom when irradiated by ultraviolet light, b. reacting said short-lived free radicals with relatively heavy hydrocarbons to produce long-lived free radicals therefrom, c. combining said long-lived free radicals with a fluid fossil fuel, and d. combusting said fuel and said long-lived free radicals.

2. The method of improving the combustion efficiency of fossil fuels, comprising the steps of (a) photochemically generating long-lived radicals, (b) combining said radicals with said fuels, and, (c) combusting said fuels and said radicals, said radicals being generated by exposing an ultraviolet light-absorbing organic compound to ultraviolet radiation to produce short-lived free radicals therefrom and then reacting said short-lived free radicals with relatively heavy hydrocarbons at ambient temperatures to produce said long-lived free radicals therefrom.

3. The method of claim 1 wherein said organic chemical is selected from the group consisting of acetone, ethene, ethanol, 1, 3 butadiene and 1, 3, 5 hexatriene.

4. The method of claim 1 wherein said heavy hydrocarbons are in the range of $C_{16}$ to $C_{20}$.

5. The method of claim 1 wherein said ultraviolet light has a maximum peak of of approximately 280 nm.

6. The method of claim 1 wherein said heavy hydrocarbons are alkanes with carbon chains in the range of $C_{16}$ to $C_{20}$.

7. The method of claim 1 wherein said fossil fuel is fluid mixed with air and said long-lived free radicals are combined with the air-fuel mixture prior to the ignition thereof.

8. The method of claim 1 wherein said long-lived free radicals are combined with said fuel in a ratio of approximately one part of long-lived free radicals to fourteen parts of fuel.

9. The method of claim 1 wherein said long-lived free radicals are selected from the class consisting of free radicals formed by the cleavage of covalent bonds.

* * * * *